United States Patent [19]

Martikainen et al.

[11] Patent Number: 4,686,843

[45] Date of Patent: Aug. 18, 1987

[54] CYLINDERLOCK-KEY-COMBINATION

[75] Inventors: Kaarlo Martikainen; Kyösti Nevalainen, both of Joensuu, Finland

[73] Assignee: Oy Wärtsilä Ab, Helsinki, Finland

[21] Appl. No.: 846,879

[22] Filed: Apr. 1, 1986

[30] Foreign Application Priority Data

Apr. 11, 1985 [FI] Finland ..... 851441

[51] Int. Cl.[4] ..... E05B 29/02

[52] U.S. Cl. ..... 70/366; 70/453

[58] Field of Search ..... 70/365, 366, 389, 453, 70/454

[56] References Cited

U.S. PATENT DOCUMENTS

| | | | |
|---|---|---|---|
| 3,029,626 | 4/1962 | Jacobi | 70/453 |
| 3,418,833 | 12/1968 | Kerr | 70/389 |
| 3,478,549 | 11/1969 | Schlege | 70/453 |
| 3,597,948 | 8/1971 | Johnstone | 70/453 |
| 4,351,172 | 9/1982 | Martikainen | 70/366 |

*Primary Examiner*—Robert L. Wolfe

*Attorney, Agent, or Firm*—Dellett, Smith-Hill and Bedell

[57] ABSTRACT

The invention relates to disc cylinder lock-key-combination, including a cylinder housing (1), and inside thereof, a turnable inner cylinder (2), which encloses a set of discs comprising a number of locking discs (3,4) provided with peripheral notches (8) and separated from one another by means of intermediate discs (5), and a locking bar (10), which in the locked position of the lock is located partly in a groove in the cylinder housing and partly in a slot (9) in the inner cylinder thereby preventing the inner cylinder to be turned with regard to the cylinder housing. The locking discs (3,4) are turnable by means of the key (12) of the lock into a position, in which the peripheral notches (8) form a uniform channel at the position of said slot (9) of the inner cylinder, into which channel the locking bar (10) can enter from the groove of the cylinder housing thereby releasing the inner cylinder to turn with regard to the cylinder housing. In accordance with the invention a guiding element (18), cooperating with the key (12) and extending at least substantially across the axial length of the set of discs, is arranged in the keyway formed jointly by the key openings (6,7) of the discs (3,4,5) in the set of discs. The lock includes further at least one member (3,23) turning continuously with the key when the key is turned in the lock, to which member the guiding element (18) is supported and from which the guiding element (18) is arranged to receive its guidance.

19 Claims, 19 Drawing Figures

Figure 1:
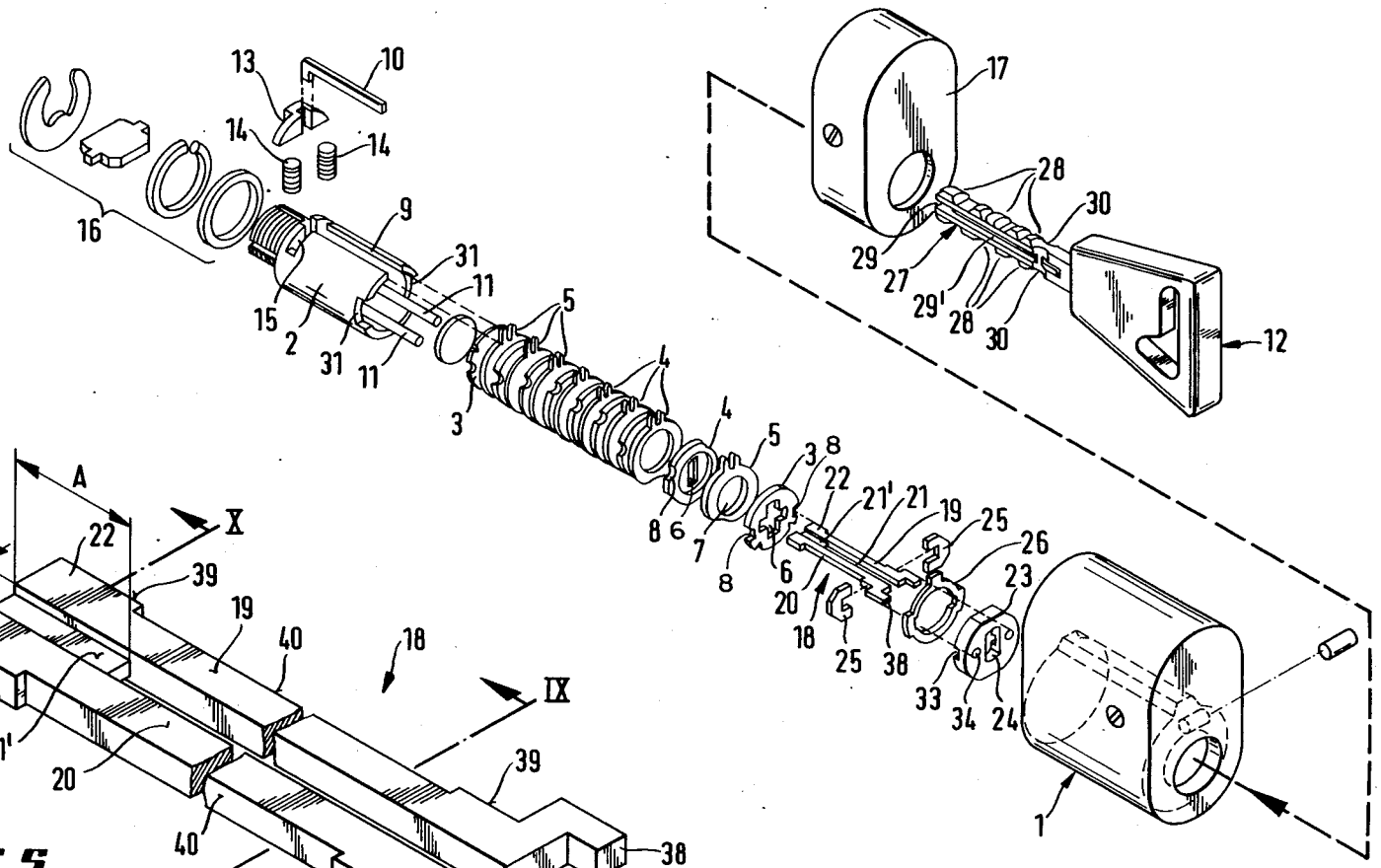

FIG. 2a
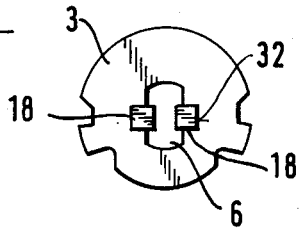
FIG. 3a
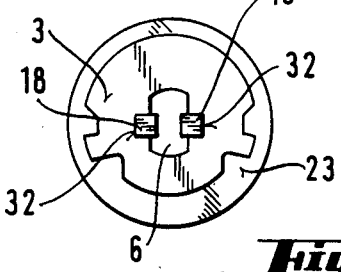
Fig. 2
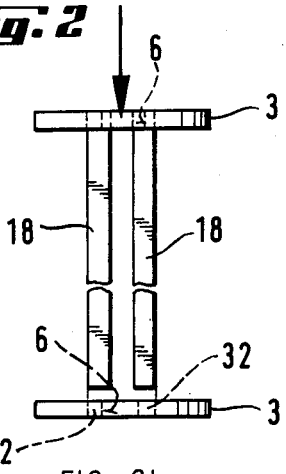
Fig. 3
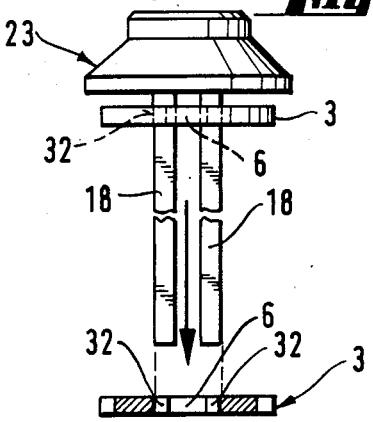
FIG. 2b
FIG. 3b
Fig. 4
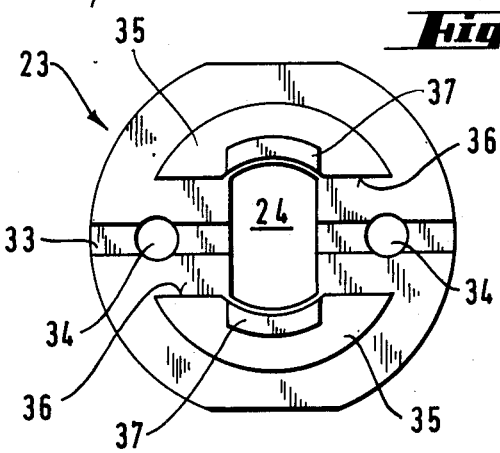
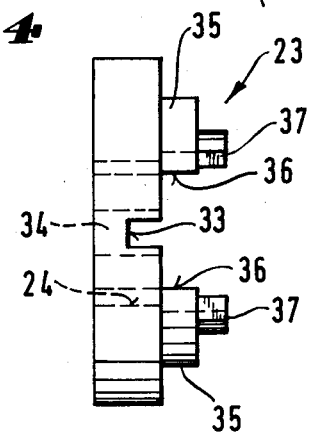
FIG. 4a
FIG. 4b 12
27
29
29'
30
44
18
19
20
21
21'
22
39
40
B

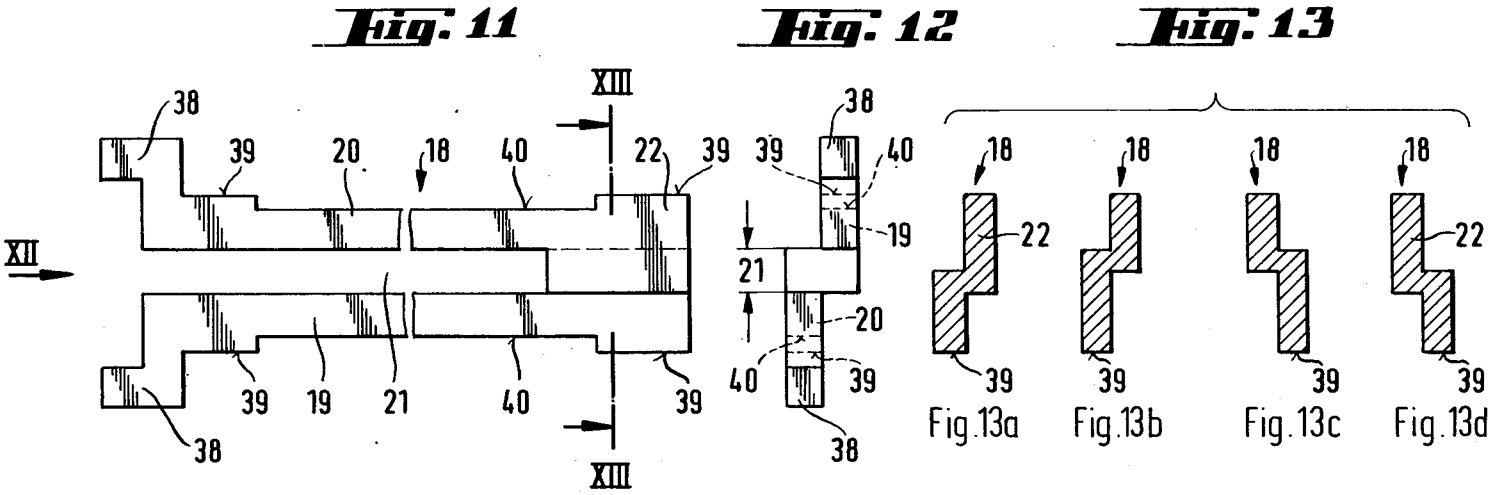
Fig. 11
Fig. 12
Fig. 13
Fig. 13a
Fig. 13b
Fig. 13c
Fig. 13d
XII
XIII
XIII
18
19
20
21
22
38
39
40
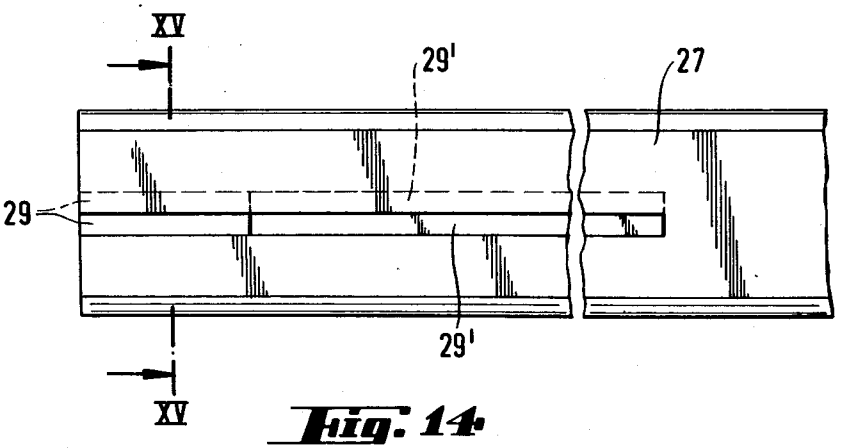
Fig. 14
Fig. 15
XV
XV
27
29
29'

CYLINDERLOCK-KEY-COMBINATION

The invention relates to a disc cylinder lock - key - combination according to the preamble of claim 1.

The lock type the invention relates to provides a very great number of possible different opening combinations depending on the number of locking discs. The lock type is also very well suited for accomplishing extensive and complicated mastered systems. This kind of systems can include a considerable number of also such opening combinations, which as such are not necessarily used in any locks to be installed but which despite this fact are 'used' from the view point of the lock manufacturer, because otherwise there is a risk that a key will be detected from outside of a certain mastered lock system which key is suitable for some lock within said system.

The number of opening combinations available can be multiplied and mastered systems can further be made more versatile in the way as is shown in the U.S. Pat. No. 4,127,996, According to this different key profiles can be used for accomplishing various lock families. A profile means in this connection the basic cross-sectional form of the blade of a key blank before the individualizing cuttings are made thereto so as to make of it a key conforming to the opening combination of the corresponding lock. The suitability of a key profile for a lock is determined by the form of the key opening of the locking discs in the lock, whereby the profile of a key can be changed, if so is wished, even several times along the axial direction of the key blade by arranging, at required positions in the keyway in the inward direction thereof, locking discs with a more limited opening for the key. The system can with advantage be built up for instance such that a certain basic profile is selected and provided with one or several axial grooves or the like identations of different size and different length at different positions in the profile so that the profile is at its smallest at that end of the key first to be inserted in the lock and at its largest at the base of the key blade, and that for separate lock groups locking discs are provided, at the positions along the keyway as required for the changes of profile, including a key opening corresponding to the change in profile. Thus, certain profiles can be arranged to be suitable also for lock groups intended for other profiles and, on the other hand, there can also be lock groups for which only keys with a certain profile are suitable.

A system thus created is especially advantageous from the viewpoint of key security, which above all is involved with providing additional keys for sets of locks already delivered. Hereby certain key profile forms can be kept such that additional keys based on these profiles can be obtained only from the lock factory and/or the delivery thereof is otherwise very restricted and strictly controlled. If required certain big clients can be provided with profiles of their own, so that no other key profiles in use are suitable for the locks corresponding thereto.

An object for the invention is to further improve the system described above and to create new possibilities and new ways for accomplishing new key profile forms and hence to make the possibilities of using different key blade forms more extensive and versatile for fulfilling the objects for the systems and for key security more effectively.

In disc cylinder locks and especially in embodiments, in which the lock can be opened by turning the key in either direction in the lock, it may occur that the locking discs of the lock can get more or less scrambled either unintentionally or due to careless use. In this connection a clear distinction should be made between this kind of unintentional scrambling and the scrambling which is due to normal operation of the lock mechanism when locking the lock by returning the key into the removal position. Hence, it can be difficult to insert the key of the lock in the lock or to remove it from the lock and the result in the worst case can even be that the set of discs of the lock gets jammed so that the lock cannot be opened by the key of the lock, and in any case the result is increased wear in the discs and in the key. The risks for what is described above are at their highest when it is attempted to insert the key in the cylinder housing or to remove it therefrom in a wrong turning position. An object of the invention therefore is also to improve the security of operation of the disc cylinder lock - key - combination and to eliminate the drawbacks mentioned above by preventing the set of discs of the lock from being unintentionally scrambled, by decreasing wear in the keyway and in the key and by making it easier to use the key in connection with opening and locking the lock.

The objects of the invention are achieved in the way disclosed more precisely in claim 1 and in the subclaims. By arranging, into the keyway of the lock, a guiding element, cooperating with the key, supported to some member turning continuously with the key and restricting for its part the keyway, several new ways are obtained for defining the form or the profile of the key blade suitable for the keyway of a lock and, thus, numerous new lock groups can be provided, for which only certain new key profiles are operably suitable. This is apt to forward provision of more realiable key security systems.

By means of said guiding element also the movements of the key in the keyway are guided, which prevents unintentional and uncontrolled scrambling of the locking discs by means of the key. Especially in the disc cylinder lock type, which can be opened in both turning directions and in which returning of the locking discs into the initial locking position of the lock mechanism takes place by means of so called O-locking discs, turning continuously with the key, and return bars arranged in cooperation therewith, the guiding element according to the invention prevents bending of said return bars.

The guiding element can be supported and guided in the keyway by different ways and the guiding element itself can be formed and put into practice in different ways. Thus, the guiding element can comprise one or preferably two guiding bars positioned at both sides of the keyway and fixed to said O-locking discs in the set of discs at both ends thereof. In addition to and instead of the O-locking discs the guiding element can be supported to a ring-like limiting member arranged between the cylinder housing and the inner cylinder at the side of the insertion end for the key and turnable by means of the key of the lock.

The guiding element can also be designed such that it includes two guiding members extending at both sides of the keyway in the lengthwise direction thereof across the set of discs and connected to each other to form a uniform body part at the inner end of the keyway. This kind of uniform guiding element can with advantage be supported to said ring-like limiting member for the key also without rigid attachment. In addition it can be installed in the keyway also after the set of discs have already been assembled and installed in the inner cylinder, so it is quite easily replaceable. This is advantageous when variation of the form and the dimensions of the guiding element are systematically made use of for providing lock groups operable with separate key profiles. In this case, namely, by replacing the guiding element the old key of the lock can be arranged to be unsuitable for the lock due to its profile and thus the possible misuses by means of the old key can be prohibited without any need to necessarily change the actual opening combination of the lock.

The actual variations of the form of the guiding element can with advantage be carried out in case the body part therof is designed to be plate-like. The dimension of the body part in the longitudinal direction of the keyway can be variated. Likewise and simultaneously the form and the dimensions of the body part in the transverse direction of the keyway can also be variated for accomplishing different guiding elements and further for providing lock groups operable with different key profiles.

In order to be able to further improve the effect of the guiding element in preventing unintentional scrambling of the set of discs and wear in the key and in the keyway, in the arrangement according to the invention a ring-like guiding member can be arranged at the end of the inner cylinder and the set of discs at the insertion end for the key and, in cooperation therewith, preferably two limiting members positioned at opposite sides of the keyway, to which members the turning movement of the key in the lock is transmitted so that the limiting members turn with the key around the keyway. The ring-like guiding member includes guiding surfaces under the influence of which the limiting members simultaneously with their turning movement move also in the radial direction towards the keyway. When the key of the lock, correspondingly, includes recesses or the like for said limiting members, the removal of the key from the keyway in every turning position of the key except for the certain insertion and removal position can be prevented by means of the guiding edges of these recesses and the limiting members.

An advantageous arrangement is obtained by positioning the ring-like guiding member between the inner cylinder and the limiting member for the keyway and by supporting it unturnably to the inner cylinder. Then by providing the limiting member for the keyway with protrusions or corresponding members, which support and guide said radially movable limiting members, these limiting members can be arranged further to support and guide said guiding element without actually fixing the guiding element rigidly to any member in the lock. On the other hand said guiding element for its part guides at the same time the radial movement of said limiting members and prevents the limiting members from entering loose in the keyway when the key is not in the lock.

A key or a key blank for a combination according to the invention is arranged in cooperation with said guiding element positioned in the keyway and it includes cuttings in the blade part as provided by the form of the guiding element. Therefore the blade of the key or the key blank can include, at the outer end to be first inserted in the lock, a transverse slot corresponding to the form of the body part of the guiding element and the depth thereof in the axial direction of the blade part being choosed such that the key or the key blank can be inserted in the locks of the lock family corresponding thereto all the way to the bottom of the keyway. The key blade can further be provided with grooves extending in the axial direction of the key blade at both sides substantially across the axial length thereof. These grooves can be arranged in cooperation with the guiding element so as to provide guidance for the axial movements of the key in the keyway of the lock.

In case the lock is provided with radially movable limiting members the blade of the key or the key blank is provided, at the base part or the part to be last inserted in the keyway, with transverse recesses or the like, the position of which is selected such, that the key being inserted completely at the bottom of the keyway said recesses are located at the position of said limiting members and, at the turning of the key in the lock, operate in cooperation therewith. Thereby said recesses allow turning of the key in the lock and prevent removal of the key from the lock in other than the certain selected insertion and removal position.

In the following the invention is described more in detail with reference to the attached drawings, in which FIG. 1 shows as an exploded view an embodiment of the combination according to the invention, FIGS. 2*a*, 2*b* and 3*a*, 3*b* illustrate different ways for supporting and installing the guiding element, FIGS. 4*a* and 4*b* show an embodiment of the limiting member for the keyway adaptable for supporting the guiding element.

Figure 5:
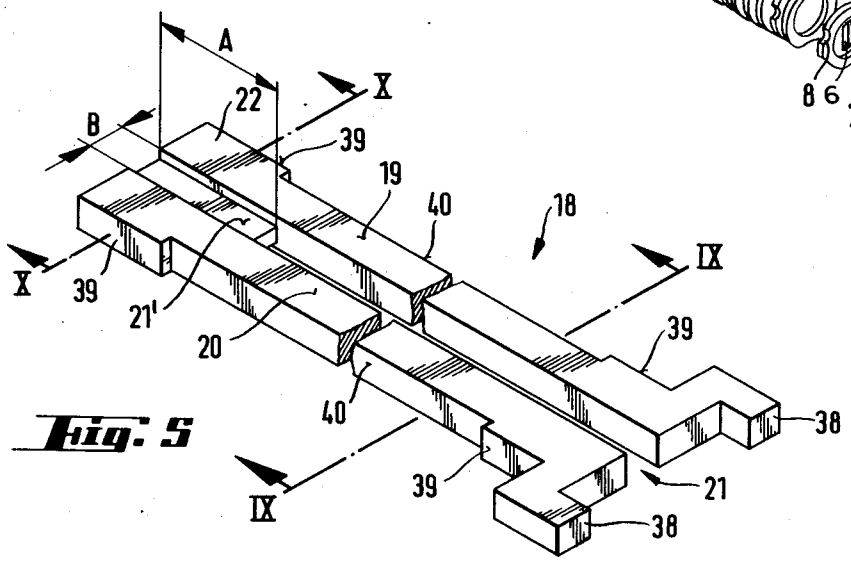
Figure 7:
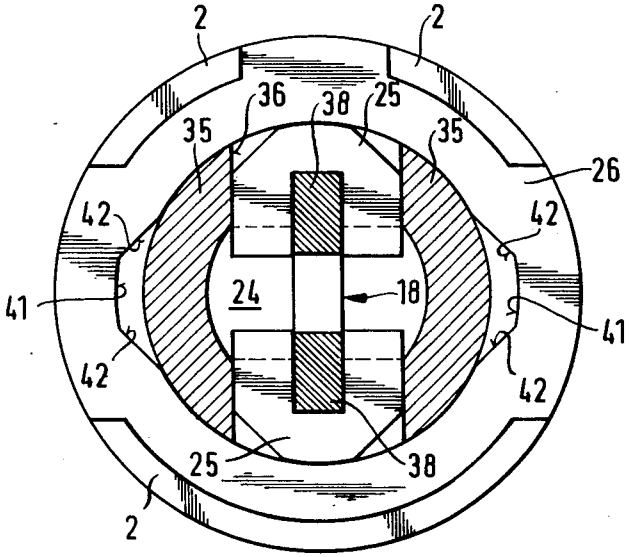
Figure 6:
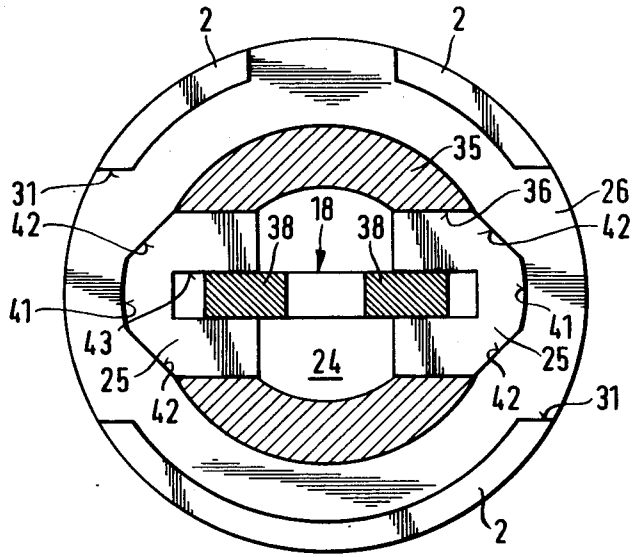
Figures 8, 8A, 8B, 9, 9A, 9B, 9C, 9D, 10, 10A, 10B, 10C, 10D:
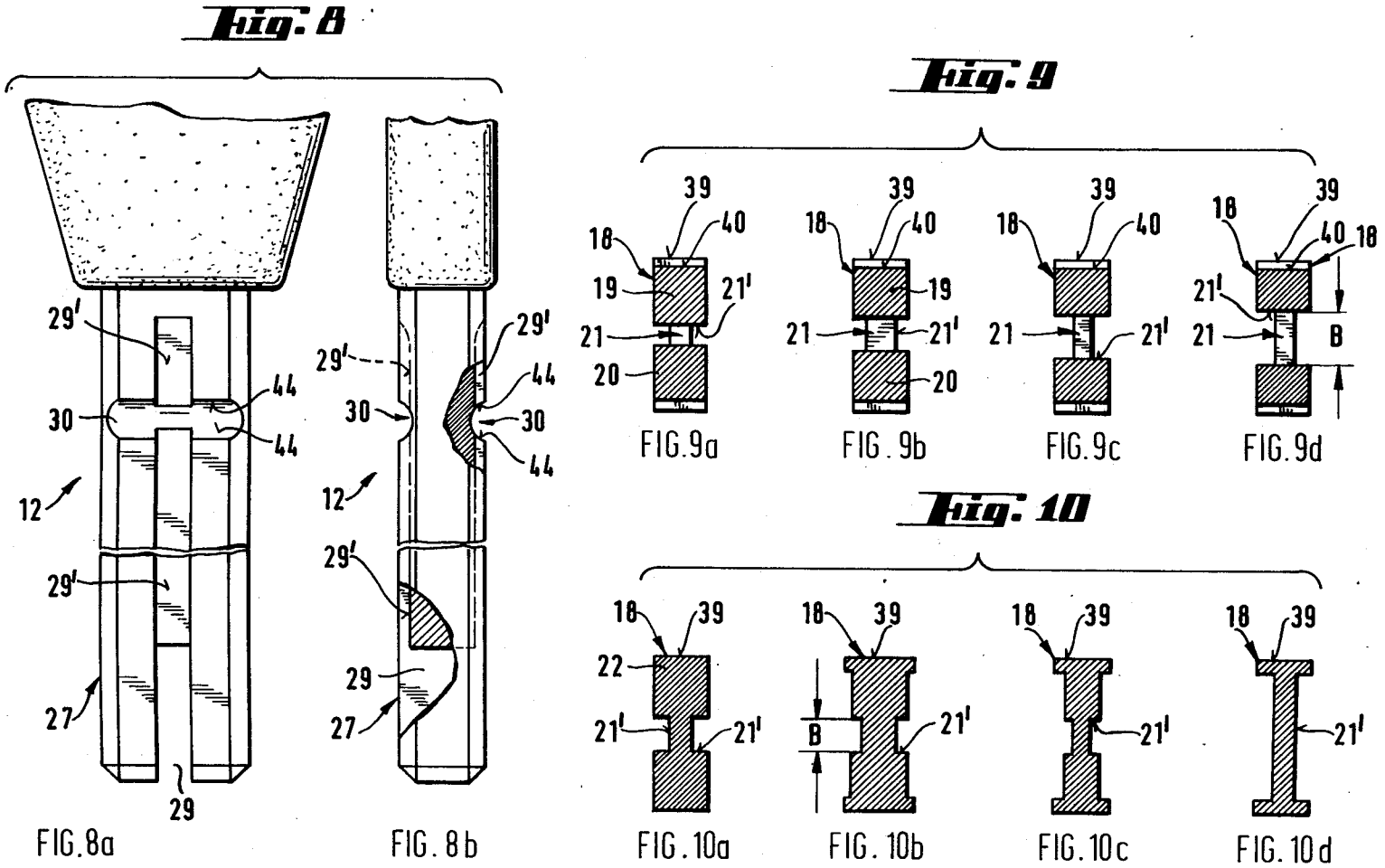
Figure 17:
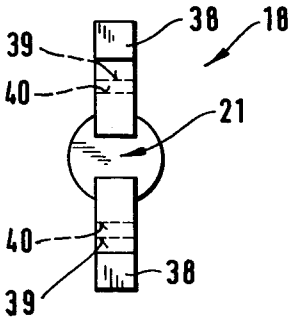
Figure 19:
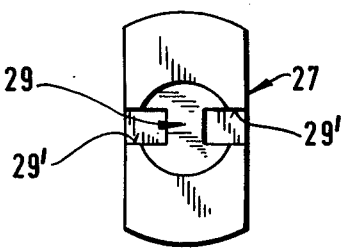
Figure 16:
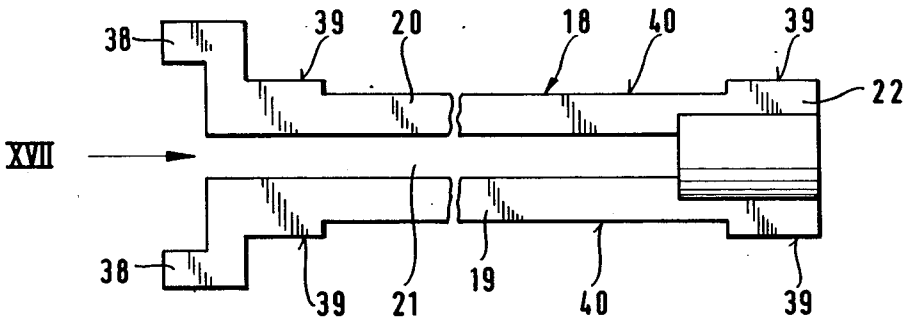
Figure 18:
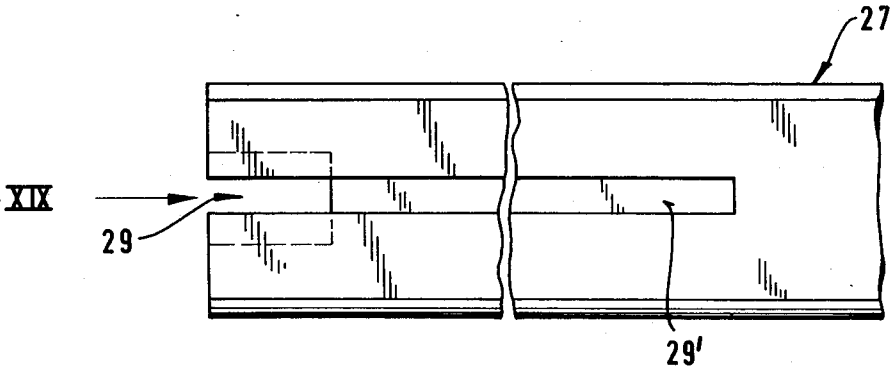

FIG. 5 shows an embodiment of the guiding element,

FIGS. 6 and 7 show the operation of the limiting members, determining the insertion and removal position for the key, when the key is turned in the lock, FIGS. 8*a* and 8*b* show an embodiment of the blade part of a key blank according to the invention, FIGS. 9*a*–9*d* illustrate possibilities for variating the profile of the guiding element at the cross-section IX—IX of FIG. 5, FIGS. 10*a*–10*d* illustrate possibilities for variating the profile of the guiding element at the cross-section X—X of FIG. 5, FIGS. 11 and 12 show a second embodiment of the guiding element as a top view and as a front view, FIGS. 13*a*–13*d* illustrate possibilities for variating the profile of the guiding element at the cross-sectional XIII—XIII of FIG. 11, FIGS. 14 and 15 show, as a top view and as a front view, an embodiment of the blade of a key blank suitable for a lock including a guiding element in accordance with FIG. 11, FIGS. 16 and 17 show a third embodiment of the guiding element as a top view and as a front veiw, FIGS. 18 and 19 show, as a top view and as a front view, an embodiment of the blade of a key blank suitable for a lock including a guiding element in accordance with FIG. 16.

In the drawing the reference numeral 1 indicates cylinder housing including, inside thereof, a turnable inner cylinder 2 enclosing a set of discs. The set of discs includes a number of locking discs 3,4 turnable with the key 12 of the lock and provided with an opening 6 for the key and with peripheral notches 8 determining the opening combination for the lock mechanism. The locking discs are separated from each other by means of intermediate discs 5 including an opening 7 for the key. The lock mechanism also includes a locking bar 10, which in the locking position of the lock is positioned partly in a groove (not shown in the drawing) in the cylinder housing and partly in a slot 9 of the inner cylinder 2 preventing the inner cylinder 2 to be turned with regard to the cylinder housing 1. The locking discs can be turned by means of the key 12 of the lock into a position, in which the peripheral notches 8 form, at the position of the slot 9 of the inner cylinder, a uniform channel in the axial direction of the lock, into which channel the locking bar 10 can enter from the groove in the cylinder housing 1 thereby releasing the inner cylinder 2 to be turned together with the key with regard to the cylinder housing 1. This turning movement of the inner cylinder 2 is further transmitted to a required member e.g. to a bolt. In FIG. 1 the reference numeral 16 generally indicates means for locking the inner cylinder 2 together with its set of discs in the axial direction in the cylinder housing 1 and for accomplishing force transmission from the inner cylinder 2. Reference numeral 17 indicates a cover to be installed on the cylinder housing.

FIG. 1 shows an embodiment of a disc cylinder lock which can be unlocked in both turning directions. In contrast to a conventional lock operable in one direction the locking discs are returned from the unlocked position of the lock into the initial position by means of so called O-locking discs 3 positioed at the ends of the set of discs and arranged to continuously turn with the key when the key is turned in the lock. In practice the O-locking discs can with advantage be positioned at the ends of the set of discs as shown in FIG. 1. The returning force is transmitted from these O-locking discs 3 to the other locking discs 4 in the set of discs by means of return bars 11. As for the detailed operation of the mechanism we refer to the U.S. Pat. No. 4,351,172, which is hereby incorporated by reference.

In FIG. 1 a stop member 13 is arranged in a slot 15 in the inner cylinder, urged radially outwards against the cylinder housing 1 by means of spring 14, the purpose of which stop member being to indicate that the inner cylinder with the locking bar is at the position of the groove of the cylinder housing mentioned above and to forward movement of the locking bar 10 back into said groove in the cylinder housing 1 for locking the lock mechanism.

In the embodiment of FIG. 1 the blade part 27 of the key 12 includes four series of combination surface 28 cut for the locking discs of the lock. Those positioned diametrically opposite to each other must be identical, but the adjoining series of combination surfaces can be different from each other. Hereby the key is operable in the lock in two positions differing from each other 180° and turnable in the lock in either direction for opening the lock.

According to the invention the lock includes also a guiding element 18 positioned in the keyway formed jointly by the key openings 6 and 7 in the discs of the set of discs. According to the embodiment of FIG. 1 the guiding element 18 has a plate-like form and it includes two guiding members 19 and 20 extending axially across the set of discs of both sides of the keyway and interconnected at the inner end of the keyway to form a uniform body part 22. Between the guiding members 19 and 20 a slot 21 is left for the key. The slot 21 has in some embodiments of the guiding element 18 an extension in the form of groove 21' across the body part 22. The key blade 27 for its part includes a slot 29 for the body part 22 so that the key can be inserted all the way to the bottom of the keyway. The slot 29 extends as a groove 29' along both sides of the key blade 27. In this embodiment the guiding element 18 is supported to a limiting member 23 for the keyway, continuously turning with the key and provided with an opening 24 for the key. The general purpose of this limiting member in the lock is on one hand to define generally the profile form for the key blade 27 suitable for the keyway and on the other hand to serve as a protecting member against drilling for protection of the keyway. The lock is also provided with two limiting members 25 positioned at opposite sides of the keyway. These cooperate with a ring-like guiding member 26, which is unturnably supported to the inner cylidner 2 by means of grooves 31 in the inner cylinder. The operation of the members 25 and 26 is described later.

FIGS. 2*a*, 2*b* and 3*a*, 3*b* show the principles for two different ways to support and to install the guiding element 18. In addition in these figures the guiding element 18 consists of two separate parts. In spite of this the principles shown in these figures can as well be adapted also to the guiding elements shown in FIG. 1 or in other figures.

In the arrangement of FIGS. 2*a*, 2*b* the guiding elements 18 are fixed in the outermost O-locking disc 3 at the end of the set of discs e.g. by soldering, welding or glueing. The O-locking discs 3 at both ends of the set of discs include grooves 32 for the guiding elements 18. The installation takes place by inserting the outer O-locking disc 3 of the set of discs with the guiding elements fixed thereto in the inner cylinder 2 and through the ready-installed set of discs (not shown in FIGS. 2 and 3) such that the guiding elements are arranged in the grooves 32 of the innermost O-locking disc 3 of the set of discs. Thus the guiding elements 18 are at their both ends supported to the O-locking discs 3 turning continuously with the key and prevent the other locking discs 4 from being unintentionally scrambled so that the opening of the lock becomes more difficult or is hampered. At the same time bending of the return bars 11 by means of the key is prevented as well, because the O-locking discs 3 effecting on different ends of the return bars are mutually interconnected by means of the guiding elements 18. The arrangement of FIGS. 3*a*, 3*b* differs from the arrangement of FIG. 2 only therein that the guiding elements 18 are supported to the limiting member 23 for the keyway and are inserted, when installed, through the whole set of discs, that is also through the topmost or outermost O-locking disc 3.

FIGS. 4*a* and 4*b* show the limiting member 23 for the keyway according to FIG. 1 viewed in the direction of the set of discs and from the side. The limiting member 23 includes a groove 33 and openings 34 for protrusions 38 in the guiding element 18 (cf. FIG. 5) for supporting the guiding element 18. The limiting member 23 includes also guiding protrusions 35, provided with guiding surfaces 36 and guiding the radial movement of the limiting members 25, and support members 37, which are positioned in the key opening 6 of the outermost O-locking disc 3 when installed and thereby connect said O-locking disc 3 and the limiting member 23 with each other.

In FIG. 5 the guiding element 18 according to FIG. 1 is shown more precisely. Edges 39 cooperate with grooves 32 in the O-locking discs 3. The guiding element 18 includes at both sides thereof also recesses 40, which are located in the keyway at the position of the other locking discs 4 so that the guiding element 18 is allowed to turn with the O-locking discs 3 independent of the other locking discs 4.

In FIGS. 6 and 7 the operation principles of the limiting members 25 are shown more precisely. In the figures the members are shown as viewed towards the set of discs and partly in section such, that the main part of the limiting member 23 for the keyway has been left away, whereby only the guiding protrusions 36, shown in section, are left to be se seen of the limiting members 23. The operation is based on turning of the key in the keyway, but for a matter of clearness the key is not shown. In the initial position, or when the key is inserted in the keyway, the limiting members 25 are located in grooves 41 of the ring-like guiding member 26 at opposite sides of the keyway. The limiting members 25 are supported, for the outer edges thereof, to the guiding surfaces 36 of the guiding protrusions 36 in the limiting member 23 for the keyway and, from inner edges 43 thereof, to the protrusions 38 of the guiding element 18, which prevent the limiting members 25 from entering loose into the keyway when the key is not in the lock.

When the key is started to be turned in the lock the limiting member 23 for the keyway with its guiding protrusions 35 and the guiding element 18 connected to the limiting member 23 turn simultaneously. As a consequence thereof the turning movement is transmitted also to the limiting members 25, which under positive guidance of the inclined guiding surfaces 42 in the grooves 41 of the ring-like guiding member 26 simultaneously move radially towards the keyway as indicated in FIG. 7.

Naturally, a condition for the above described radial movement of the limiting members 25 is that there is a corresponding recess in the key of the lock allowing said movement. FIGS. 8*a* and 8*b* show as an enlarged view the blade part 27 of a key blank suitable for a lock according to the invention and including recesses 30 provided with guiding surfaces 44 for the limiting members 25. As the question is about a key blank, the blade part 27 does not include the combination surfaces 28 shown in the ready cut key 12 in FIG. 1. In case the key of the lock does not include a suitable recess at right place, said radial movement of the limiting members 25 is prevented and the key cannot at all be turned in the lock. On the other hand the guiding surfaces 44 of the recesses 30 together with the limiting members 25 prevent removal of the key from the lock in other than the original insertion and removal position. Hereby the set of discs is effectively prevented from being scrambled unintentionally or in purpose as a result thereof that the key is drawn or it is attempted to be drawn from the lock in a wrong position. At the same time this arrangement clearly indicates for the user of the lock the correct position for insertion and removal of the key, because in other positions these measures simply cannot be accomplished. It follows further that it is possible considerably to diminish wear in the key and in the keyway, because one cannot move the key in axial direction of the keyway at incorrect turning positions. When the key is then removed from the lock in the correct position the guiding surfaces 44 press the limiting members 25 back into the grooves 41 in the ring-like guiding member 26.

As especially apparent from FIGS. 6 and 7 and what is clear otherwise as well, the guiding element 18 restricts the keyway for its part. This quality can with advantage be availed of for determining what kind of key profile or form of the key blade is suitable for each lock. Hence, the locks can be divided correspondingly to different lock families on the basis of this quality by variating different dimensions of the guiding element 18. As the variation can be accomplished so that a certain key profile is suitable also for locks intended for other kinds of key profiles but not vice versa, said variation can with advantage be used also for master keying separate locks and lock groups. Especially versatile lock group and master keying systems are obtained by making use of both variation of the dimensions of the guiding element 18 and variation of the form and size of the key opening of the locking discs. For the last mentioned part we refer to said U.S. Pat. No. 4,127,996, which is hereby incorporated by reference. Both of these variating possibilities can with ease and in an uncomplicated manner be availed of when modifying locks already installed, for it is sufficient that a different guiding element is changed in the lock or, correspondingly, even only one locking disc is changed, the key opening of which is formed such that it causes an additional restriction in the keyway at the position of the locking disc in question.

In practice the dimensions of the guiding element 18 can be variated in many different ways. One way is to variate the axial length A of the body part 22 (FIG. 5, groove 21'). Another way is to variate the width B of the slot 21 and the groove 21'. The thickness of the body part 22 at the position of the groove 21' can be variated as well. Further the thickness of the guiding members 19 and 20 and the form and thickness of the body part 22 in the transverse direction of the guiding element can be variated. In addition the profile of the guiding element 18 can be changed in the axial direction so that the profile becomes larger to the bottom of the keyway. Variation possibilities for the profile of the guiding element 18 are illustrated with FIGS. 9*a, b, c* and *d* and 10*a, b, c* and *d* showing a section of the guiding element 18 at the positions IX—IX and X—X in FIG. 5. It is clear that the key suitable for a lock corresponding to each different guiding element has to include a slot 29 corresponding to the length A of the body part 22 of the guiding element and to the other shapes thereof so that the key can be inserted all the way to the bottom of the keyway. This is true, respectively, for the members 19,20 of the guiding element and the grooves 29' corresponding thereto and located at both sides along the key blade 27. FIGS. 11,12,13 and 16,17 illustrate further in what different ways the shape of the guiding element 18 can be variated and FIGS. 14,15 and 18,19 show correspondingly how these changes influence the shape of the slot 29 and the grooves 29' of the blade part 27 of the key. FIGS. 13*a, b, c* and *d* illustrate variation possibilities of the guiding element according to FIGS. 11,12. For the part of the guiding element 18 it can further be generally added that by making the keyway smaller the picking possibilities are simultaneously decreased and breaking of the cylinder is made more difficult. The invention is not limited to the embodiments above but several modifications are feasible within the scope of the attached claims.

We claim:

1. In combination, a disc cylinder lock and a key for operating the lock, the lock having a locked condition and an unlocked condition and comprising:

a cylinder housing formed with a groove at its interior, an inner cylinder inside the cylinder housing and formed with a slot, the inner cylinder being held against turning relative to the cylinder housing when the lock is in its locked condition and being turnable relative to the cylinder housing when the lock is in its unlocked condition, a set of discs inside the inner cylinder, each disc having a key opening and the key openings jointly forming a keyway which extends axially of the inner cylinder between an outer, key insertion, end and an inner end and the discs, when the lock is in the locked condition, having a key insertion position in which the key can be inserted fully into the keyway, the set of discs including locking discs and intermediate discs, each locking disc having a peripheral notch, the unlocked condition of the lock being the condition in which the peripheral notches of the locking discs are alinged with each other and form a channel at the position of the slot in the inner cylinder, and the locking discs including O-locking discs which turn continuously with the key when the key is turned in the lock, a locking bar which, in the locked condition of the lock, is located partly in the groove of the cylinder housing and partly in the slot of the inner cylinder, thereby preventing the inner cylinder from being turned relative to the cylinder housing, the locking discs being turnable by means of the key to place the lock in the unlocked condition so that the locking bar can enter the channel formed by the peripheral notches of the locking discs and permit the inner cylinder to turn relative to the cylinder housing, a ring-like limiting member for the keyway, the limiting member being arranged between the cylidner housing and the inner cylinder at the outer end of the keyway and being turnable by means of the key, At least one return bar mounted in the inner cylinder and extending longitudinally across the set of discs and to which power is transmitted from the key by means of said O-locking discs for returning the locking discs from the unlocked condition of the lock to the locked condition, whereby the lock can be placed in the unlocked condition by turning the key in either direction from the key insertion position, and a guiding element arranged in the keyway and restricting the keyway and thereby determining at least partly the form of a key that can be inserted fully into the keyway, the guiding element being supported by the ring-like limiting member and including two guiding members extending longitudinally of the keyway across the set of discs and connected to each other at the inner end of the keyway by a body part, the guiding element guiding movement of the key in the keyway and thereby preventing uncontrolled scrambling of the locking discs and bending of the return bar by means of the key.

2. A combination according to claim 1, wherein said guiding element is supported by said O-locking discs.

3. A combination according to claim 1, wherein at least one of the guiding members engage said O-locking discs in a manner preventing relative rotational movement thereof about the central axis of the keyway.

4. A combination according to claim 3, wherein the guiding members are at opposite respective sides of the keyway.

5. A combination according to claim 1, wherein said body part has a plate-like form and the dimension thereof in the lengthwise direction of the keyway determines at least partly the form of a key that can be inserted fully into the keyway.

6. A combination according to claim 1, wherein the form and the dimensions of said body part in the transverse direction of the keyway determine at least partly the form of a key that can be inserted fully into the keyway.

7. A combination according to claim 1, wherein the guiding element requires that a key, in order to be inserted fully into the keyway, should have a blade which includes at least one substantially axial groove.

8. A key or a key blank for a combination according to claim 1, having an elongate blade which has a leading end and a trailing end which are respectively the first part and the last part to enter the keyway when the key is inserted in the keyway, and the blade including, at its leading end, a transverse slot corresponding to the form of the body part of said guiding element, and the depth of the slot in the longitudinal direction of the blade being chosen such that the key or key blank can be inserted in the lock all the way to the bottom of the keyway.

9. A key or a key blank according to claim 8, wherein the blade includes grooves extending in the longitudinal direction of the blade at two opposite sides thereof over substantially its entire length, said grooves being arranged to cooperate with said guiding elemetn so as to provide guidance for axial movement of the key in the keyway of the lock.

10. In combination, a disc cylinder lock and a key for operating the lock, the lock having a locked condition and an unlocked condition and comprising:

a cylinder housing formed with a groove at its interior, an inner cylinder inside the cylinder housing and formed with a slot, the inner cylinder being held against turning relative to the cylinder housing when the lock is in its locked condition and being turnable relative to the cylinder housing when the lock is in its unlocked condition, a set of discs inside the inner cylinder, each disc having a key opening and the key openings jointly forming a keyway which extends axially of the inner cylinder between an outer, key insertion, end and an inner end and the discs, when the lock is in the locked condition, having a key insertion position in which the key can be inserted fully into the keyway, the set of discs including locking discs and intermediate discs, each locking disc having a peripheral notch, the unlocked condition of the lock being the condition in which the peripheral notches of the locking discs are aligned with each other and form a channel at the position of the slot in the inner cylinder, and the locking discs including O-locking discs which turn continuously with the key when the key is turned in the lock, a locking bar which, in the locked condition of the lock, is located partly in the groove of the cylinder housing and partly in the slot of the inner cylinder, thereby preventing the inner cylinder from being turned relative to the cylinder housing, the locking discs being turnable by means of the key to place the lock in the unlocked condition so that the locking bar can enter the channel formed by the peripheral notches of the locking discs and permit the inner cylinder to turn relative to the cylinder housing, a ring-like limiting member for the keyway, the limiting member being arranged between the cylinder housing and the inner cylinder at the outer end of the keyway and being turnable by means of the key, at least one return bar mounted in the inner cylinder and extending longitudinally across the set of discs and to which power is transmitted from the key by means of said O-locking discs for returning the locking discs from the unlocked condition of the lock to the locked condition, whereby the lock can be placed in the unlocked condition by turning the key in either direction from the key insertion position, a guiding element arranged in the keyway and restricting the keyway and thereby determining at least partly the form of a key that can be inserted fully into the keyway, the guiding element being supporting by the ring-like limiting member and guiding movement of the key in the keyway and thereby preventing uncontrolled scrambling of the locking discs and bending of the return bar by means of the key, at least one limiting element positioned to one side of the keyway and to which turning movement of the key is transmitted, and a ring-like guiding member arranged at the outer end of the keyway, the ring-like guiding member having a guiding surface which causes the limiting element to move radially inwards relative to the keyway concurrently with the turning movement thereof, and the key including a recess for receiving the limiting element when the key is turned, the recess having a guiding edge which cooperates with the limiting element to prevent removal of the key from the keyway except when the discs are in the key insertion position.

11. A combination according to claim 10, wherein said guiding element is supported by said O-locking discs.

12. A combination according to claim 10, wherein the guiding element comprises at least one guiding bar positioned at a side of the keyway and engaging said O-locking discs in a manner preventing relative rotational movement thereof about the central axis of the keyway.

13. A combination according to claim 12, wherein the guiding element has two guiding bars at opposite respective sides of the keyway.

14. A combination according to claim 10, comprising two such limiting elements at opposite respective sides of the keyway, and wherein the ring-like guiding member has guiding surfaces for guiding both limiting elements and the key includes recesses for receiving both limiting elements when the key is turned.

15. A combination according to claim 10, wherein said guiding element is arranged to guide the radial movement of said limiting element.

16. A combination according to claim 10, wherein said ring-like guiding member is supported by the inner cylinder in a manner preventing relative turning movement thereof.

17. A combination according to claim 16, wherein said ring-like guiding member is positioned between the inner cylinder and the limiting member for the keyway, and the limiting member for the keyway includes means arranged to support and to guide said radially movable limiting element and therethrough said guiding element.

18. A combination according to claim 10, wherein the guiding element requires that a key, in order to be inserted fully into the keyway, should have a blade which include at least one substantially axial groove.

19. A key or a key blank for a combination according to claim 10, having an elongate blade which has a leading end and a trailing end which are respectively the first part and the last part to be received in the keyway when the key is inserted in the keyway, and the blade including, at its trailing end, a transverse recess positioned such that upon the key being inserted completely to the bottom of the keyway said recess is located at the position of said limiting element and, upon the turning of the key in the lock, operates in cooperation with the limiting element, thereby allowing the turning of the key and preventing the key from being moved in the longitudinal direction of the blade.

* * * * *